US009938045B2

(12) United States Patent
Morand

(10) Patent No.: US 9,938,045 B2
(45) **Date of Patent: *Apr. 10, 2018**

(54) WASTE-DISPOSAL DEVICE

(71) Applicant: INTERNATIONAL REFILLS COMPANY LTD, Barbados (BB)

(72) Inventor: Michel Morand, Montreal (CA)

(73) Assignee: INTERNATIONAL REFILLS COMPANY LTD, Christ Church (BB)

( * ) Notice: Subject to any disclaimer, the term of this patent is extended or adjusted under 35 U.S.C. 154(b) by 0 days.

This patent is subject to a terminal disclaimer.

(21) Appl. No.: 15/279,746

(22) Filed: Sep. 29, 2016

(65) Prior Publication Data

US 2017/0015501 A1 Jan. 19, 2017

Related U.S. Application Data

(63) Continuation of application No. 14/383,205, filed as application No. PCT/IB2013/000554 on Mar. 5, 2013, now Pat. No. 9,598,207.

(Continued)

(51) Int. Cl.
*B65D 1/24* (2006.01)
*B65D 67/00* (2006.01)

(Continued)

(52) U.S. Cl.
CPC ..... *B65D 25/16* (2013.01); *B65D 43/26* (2013.01); *B65F 1/062* (2013.01); *B65F 1/068* (2013.01);

(Continued)

(58) Field of Classification Search
CPC ..... B65F 2001/1676; B65F 2210/136; B65F 2210/1675; B65B 67/1277

(Continued)

(56) References Cited

U.S. PATENT DOCUMENTS 3,536,192 A 10/1970 Couper
3,619,822 A 11/1971 Carmichael (Continued)

FOREIGN PATENT DOCUMENTS

EP 1212248 B1 8/2003
JP 3256847 B2 2/2002

(Continued)

OTHER PUBLICATIONS

International Search Report for corresponding application PCT/IB2013/000554 filed Mar. 5, 2013; dated Jul. 10, 2013.

(Continued)

*Primary Examiner* — J. Gregory Pickett
*Assistant Examiner* — Gideon Weinwerth
(74) *Attorney, Agent, or Firm* — Cantor Colburn LLP

(57) ABSTRACT

A waste-disposal device for use with a bag unit of the type having an annular component from which a free end of tube extends to form a bag. The waste-disposal device comprises a bin having an open top end for accessing an inner cavity of the bin. A support is in the bin adjacent to the open top end and adapted to support the annular component of the bag unit for waste to be received in the bag of the bag unit extending in the inner cavity of the bin, by passing through a central opening thereof. A closing mechanism comprises a door pivotally connected to the support by at least one pivot and an abutment surface in the bin, a pivot axis of the at least one pivot being located at a same height or higher than a bottommost edge of the annular component of the bag unit when received in the support and when the bin has a bottom thereof on the ground. The door is pivotable between a closed position in which the door presses the bag toward the abutment surface to close the bag, and an open position in which the door is away from the abutment surface to open the bag.

15 Claims, 8 Drawing Sheets

Related U.S. Application Data

(60) Provisional application No. 61/606,604, filed on Mar. 5, 2012.

(51) Int. Cl.

| | |
|---|---|
| ***B65D 25/00*** | (2006.01) |
| ***B65D 25/16*** | (2006.01) |
| ***B65F 1/06*** | (2006.01) |
| ***B65F 1/16*** | (2006.01) |
| ***B65D 43/26*** | (2006.01) |

(52) U.S. Cl.
CPC ..... *B65F 1/1607* (2013.01); *B65F 2210/167* (2013.01); *B65F 2210/1675* (2013.01); *B65F 2240/132* (2013.01)

(58) Field of Classification Search
USPC ..... 220/495.08, 263, 254.3, 827, 826, 908, 220/908.1, 908.2; 4/452; 53/567, 576
See application file for complete search history.

(56) References Cited

U.S. PATENT DOCUMENTS

| | | | | |
|---|---|---|---|---|
| 3,964,630 | A | 6/1976 | Getz | |
| 4,869,049 | A | 9/1989 | Richards | |
| 5,125,526 | A | 6/1992 | Sumanis | |
| 5,407,089 | A | 4/1995 | Bird | |
| 5,520,303 | A | 5/1996 | Bernstein | |
| 5,535,913 | A | 7/1996 | Asbach | |
| 5,590,512 | A | 1/1997 | Richards | |
| 5,799,909 | A * | 9/1998 | Ziegler | B65F 1/1415 220/481 |
| 5,971,194 | A | 10/1999 | Freeland | |
| 6,128,890 | A | 10/2000 | Firth | |
| 6,481,810 | B1 | 11/2002 | Kirchoff | |
| 6,516,588 | B2 | 2/2003 | Jensen | |
| 6,719,194 | B2 | 4/2004 | Richards | |
| 6,974,029 | B2 | 12/2005 | Morand | |
| 7,316,100 | B2 | 1/2008 | Stravitz | |
| 7,350,663 | B2 | 4/2008 | Chomik | |
| 7,406,814 | B2 | 8/2008 | Morand | |
| 7,594,376 | B2 | 9/2009 | Chomik | |
| 7,841,853 | B2 | 11/2010 | Yu | |
| 7,958,704 | B2 | 6/2011 | Stravitz | |
| D652,189 | S | 1/2012 | Morand | |
| 8,087,532 | B2 | 1/2012 | Brown | |
| 8,393,489 | B1 | 3/2013 | Stravitz | |
| 8,567,157 | B2 | 10/2013 | Dunn | |
| 8,752,723 | B2 | 6/2014 | Lucas | |
| 8,783,499 | B2 | 7/2014 | Lacy | |
| 8,899,420 | B2 | 12/2014 | Morand | |
| 9,598,207 | B2 * | 3/2017 | Morand | B65F 1/062 |
| 2002/0038535 | A1 | 4/2002 | Jensen | |
| 2003/0154696 | A1 | 8/2003 | Morand | |
| 2004/0020175 | A1 | 2/2004 | Stravitz | |
| 2005/0217214 | A1 | 10/2005 | Richardson | |
| 2006/0179795 | A1 * | 8/2006 | Barker | B65F 1/062 53/461 |
| 2006/0248862 | A1 | 11/2006 | Morand | |
| 2008/0184677 | A1 | 8/2008 | Morand | |
| 2008/0272140 | A1 | 11/2008 | Mowers | |
| 2009/0100806 | A1 | 4/2009 | Morand | |
| 2009/0126320 | A1 | 5/2009 | Rousso | |
| 2001/0056953 | | 3/2011 | Ohnishi | |
| 2011/0056967 | A1 | 3/2011 | Ohnishi | |
| 2011/0231140 | A1 | 9/2011 | Lacy | |
| 2011/0232240 | A1 * | 9/2011 | Lacy | B65F 1/062 53/576 |
| 2011/0240651 | A1 | 10/2011 | Gordon | |
| 2012/0091295 | A1 | 4/2012 | Morand | |
| 2012/0211494 | A1 | 8/2012 | Morand | |
| 2013/0298506 | A1 | 11/2013 | Lucas | |
| 2014/0263348 | A1 | 9/2014 | Liistro | |
| 2015/0021334 | A1 | 1/2015 | Morand | |
| 2016/0060029 | A1 * | 3/2016 | McConnell | B65F 1/002 383/34.1 |

FOREIGN PATENT DOCUMENTS

| | | | |
|---|---|---|---|
| JP | 05058963 | | 1/2005 |
| JP | H08026403 | A | 1/2008 |
| WO | 9939995 | A1 | 8/1999 |

OTHER PUBLICATIONS

Written Opinion for corresponding application PCT/IB2013/000554 filed Mar. 5, 2013; dated Jul. 10, 2013.

Japanese office action for corresponding Patent Application No. 2014-560458; dated Feb. 13, 2017.

* cited by examiner

WASTE-DISPOSAL DEVICE

CROSS-REFERENCE TO RELATED APPLICATION

The present application is a continuation of U.S. patent application Ser. No. 14/383,205 filed on Sep. 5, 2014, which is a U.S. national stage application filed under 35 U.S.C. 371 with respect to International Patent Application Number PCT/IB2013/000554 filed on Mar. 5, 2013, which claims priority to U.S. Provisional Patent Application No. 61/606,604 filed on Mar. 5, 2012, all of which said applications are herein incorporated by reference in their entirety.

FIELD OF THE APPLICATION

The present application relates to waste-disposal devices of the type formed by a bin or pail supporting film-dispensing units, with the tube-dispensing units dispensing a closed-end tube or bag in the bin to receive and conceal odorous waste.

BACKGROUND OF THE ART

Waste-disposal systems having tube-dispensing units or refills are commonly used, for numerous reasons. One of the reasons is that such systems often have mechanisms to close a bag formed from the tube dispensed by the tube-dispensing units, thereby retaining odors in the bag.

SUMMARY OF THE APPLICATION

It is therefore an aim of the present disclosure to provide a novel waste-disposal device.

It is a further aim of the present disclosure to provide a waste-disposal device for tube-dispensing units addressing issues associated with the prior art.

Therefore, in accordance with a first embodiment of the present application, there is provided a waste-disposal device for use with a bag unit of the type having an annular component from which a free end of tube extends to form a bag, the waste-disposal device comprising: a bin having an open top end for accessing an inner cavity of the bin, a support in the bin adjacent to the open top end and adapted to support the annular component of the bag unit for waste to be received in the bag of the bag unit extending in the inner cavity of the bin, by passing through a central opening thereof; and a closing mechanism comprising a door pivotally connected to the support by at least one pivot and an abutment surface in the bin, a pivot axis of the at least one pivot being located at a same height or higher than a bottommost edge of the annular component of the bag unit when received in the support and when the bin has a bottom thereof on the ground, the door being pivotable between a closed position in which the door presses the bag toward the abutment surface to close the bag, and an open position in which the door is away from the abutment surface to open the bag.

Further in accordance with the present disclosure, the support has a ring body to support the annular component of the bag unit.

Still further in accordance with the present disclosure, the ring body defines an annular cavity for receiving the annular component of the bag unit.

Still further in accordance with the present disclosure, the ring body has an inner annular wall located in the central opening of the annular component of the bag unit when the bag unit is in the support.

Still further in accordance with the present disclosure, the at least one pivot has a portion connected to the inner annular wall.

Still further in accordance with the present disclosure, the abutment surface is part of the support.

Still further in accordance with the present disclosure, the abutment surface is oblique relative to a vertical axis of the bin to define a contact surface for the bag pressed by the door in the closed position.

Still further in accordance with the present disclosure, the at least one pivot is located inside an vertical annular projection of the central opening.

Still further in accordance with the present disclosure, the pivot axis is located at a same level or lower than an uppermost edge of the annular component.

Still further in accordance with the present disclosure, a biasing component is between the door and the bin, to bias the door to the closed position.

Still further in accordance with the present disclosure, a lid selectively closes the open top end.

Still further in accordance with the present disclosure, an annular funnel is provided to which the lid is pivotally connected, the annular funnel covering the annular component positioned in the support.

Still further in accordance with the present disclosure, the door is curved.

Still further in accordance with the present disclosure, a curvature of the door has a center of radius on a same side as a radius of curvature of the central opening.

Still further in accordance with the present disclosure, the center of radius of the door is in the central opening.

DESCRIPTION OF THE PREFERRED EMBODIMENTS

Figure 1:
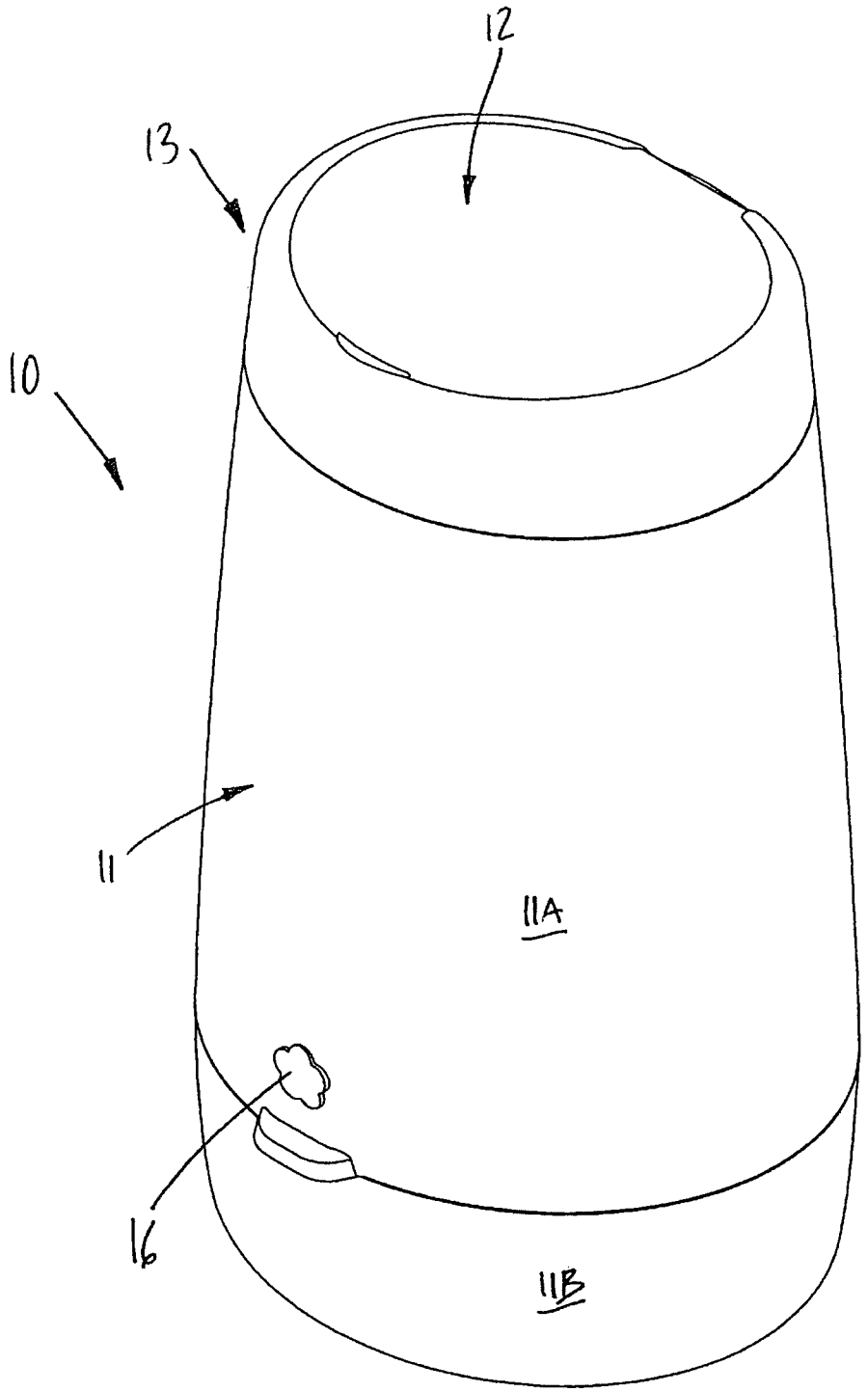
FIG. 1 is a perspective view of a waste-disposal device in accordance with an embodiment of the present disclosure.
Figure 2:
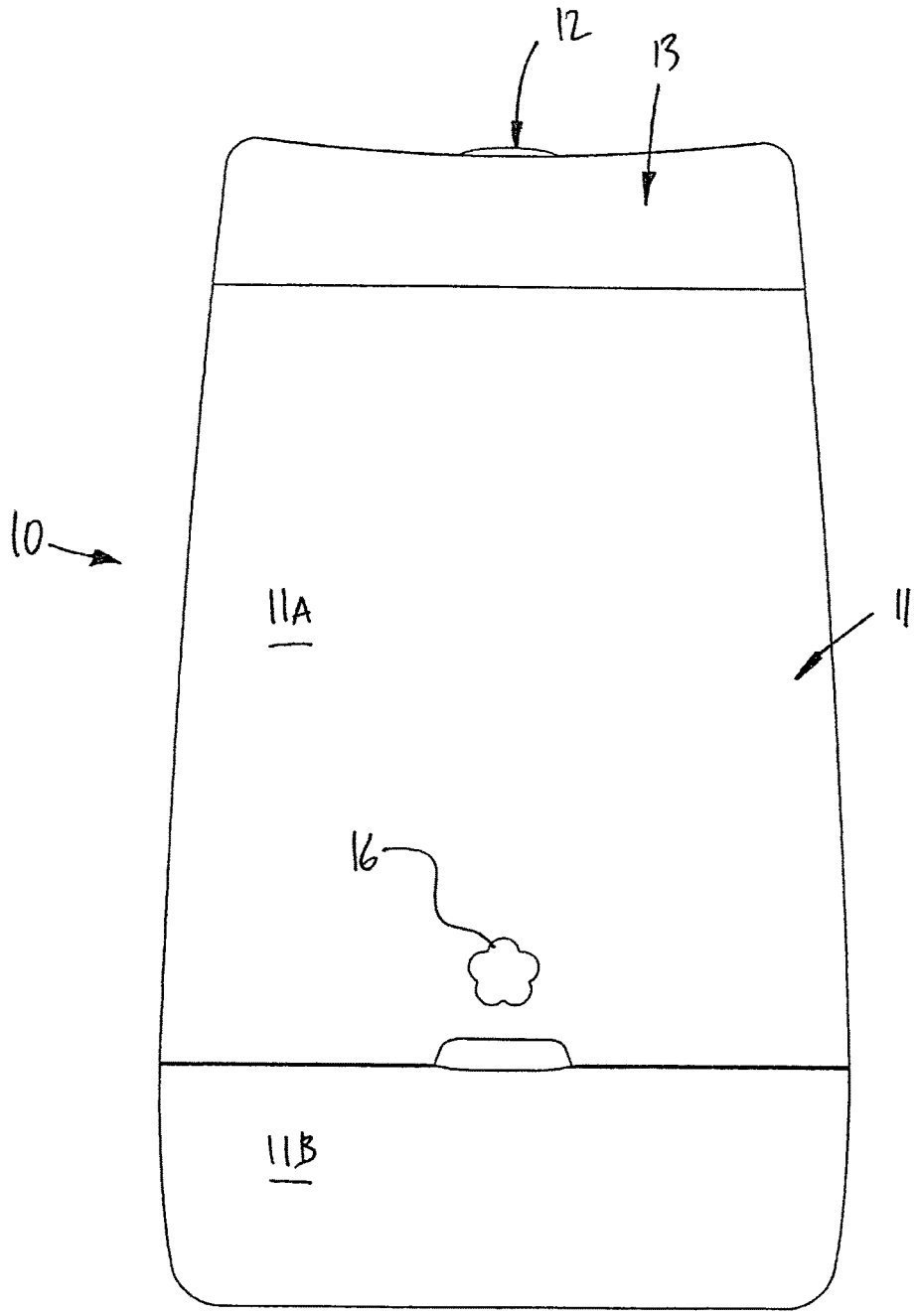
FIG. 2 is a front elevation view of the waste-disposal device of FIG. 1.
Figure 3:
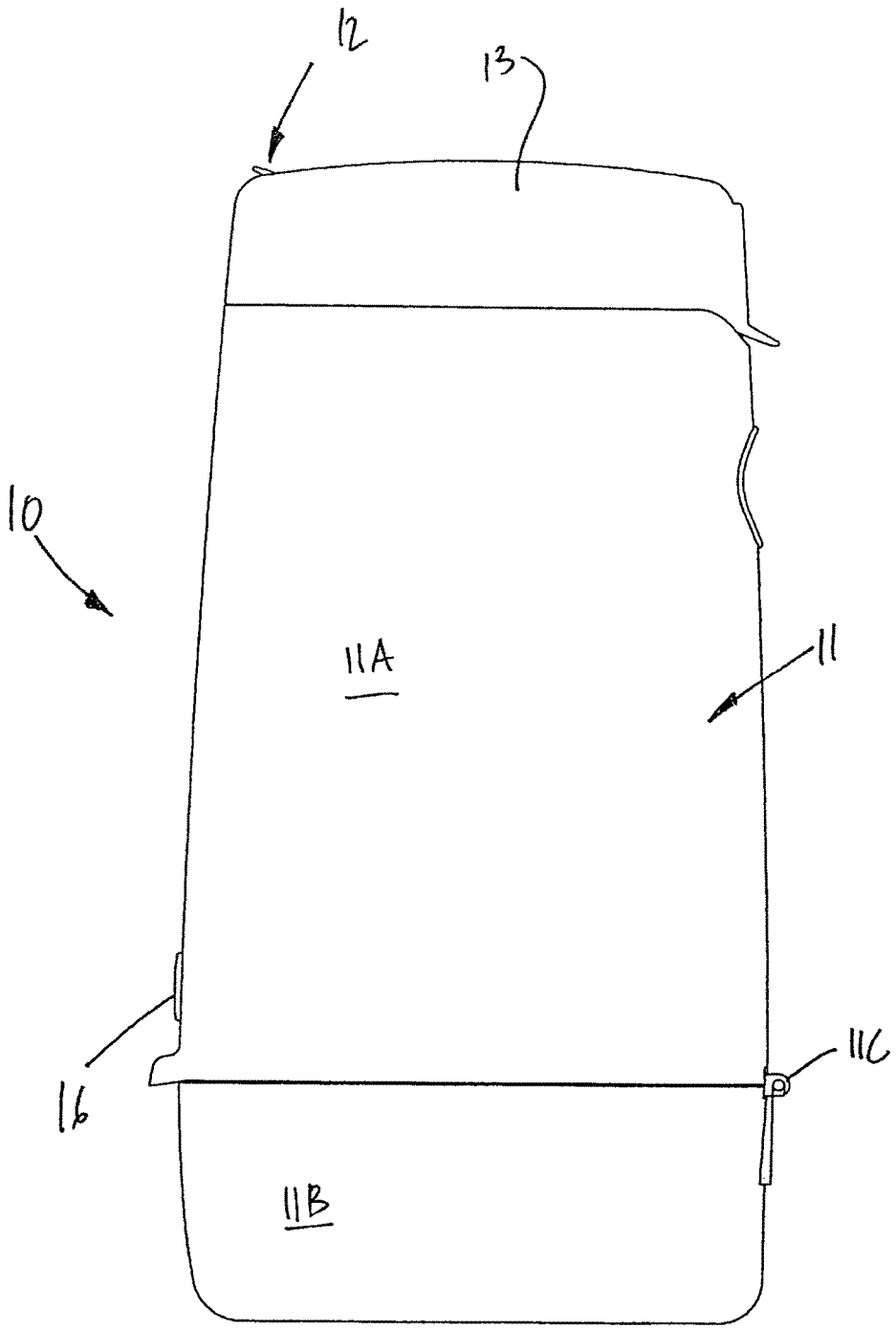
FIG. 3 is a side elevation view of the waste-disposal device of FIG. 1.
Figure 4:
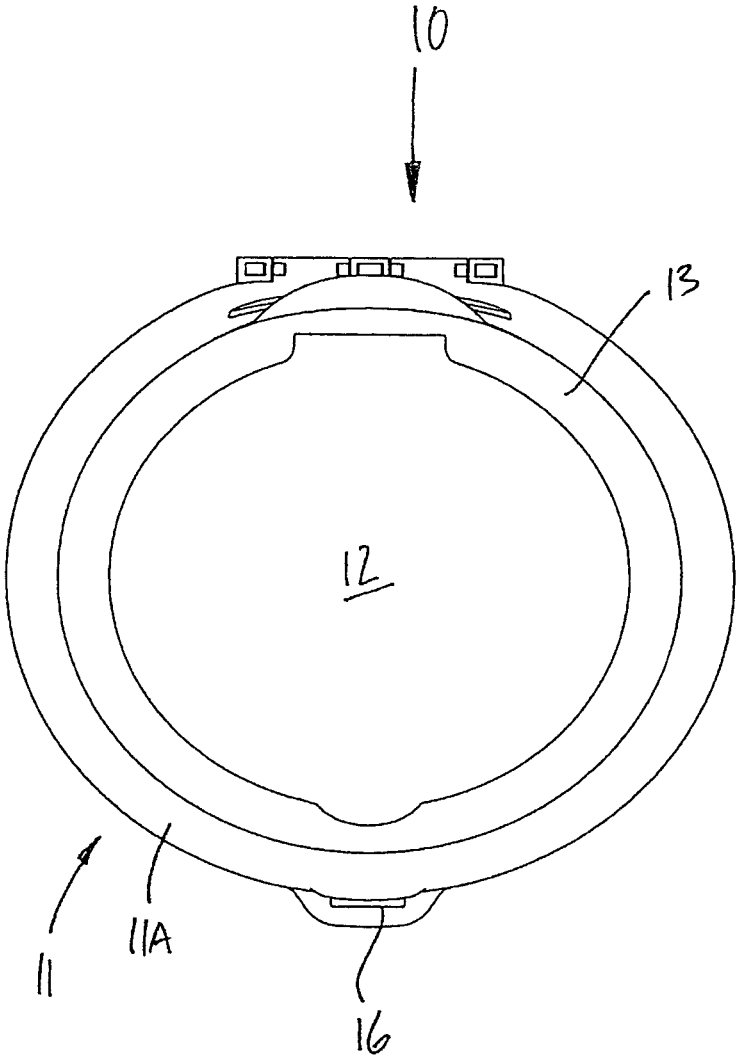
FIG. 4 is a top plan view of the waste-disposal device of FIG. 1.

Referring to the drawings, and more particularly to FIGS. 1 to 3, there is illustrated a waste-disposal device 10 in accordance with an embodiment of the present disclosure. The waste-disposal device 10 is of the type having a bin 11 for accommodating waste.

The bin 11 defines an inner cavity for accommodating waste. A lower portion of the inner cavity of the bin 11 receives a bag in which waste may be dumped. Any appropriate waste may be dumped into the bin 11, but the waste-disposal device 10 may be used efficiently with diapers, pet litter, and other such odorous waste.

The interior of the bin 11 is accessible via an open top end thereof. The open top end of the bin 11 may be covered and/or closed by different covering devices, namely lid 12 and funnel 13. The open top end may have any appropriate shape, such as that of a square, a rectangle, an ellipse, a circle, etc. In an embodiment, the lid 12 is pivotally connected to a rim of the funnel 13, with the funnel 13 being releasably secured to the top open end of the bin 11.

Figure 6:
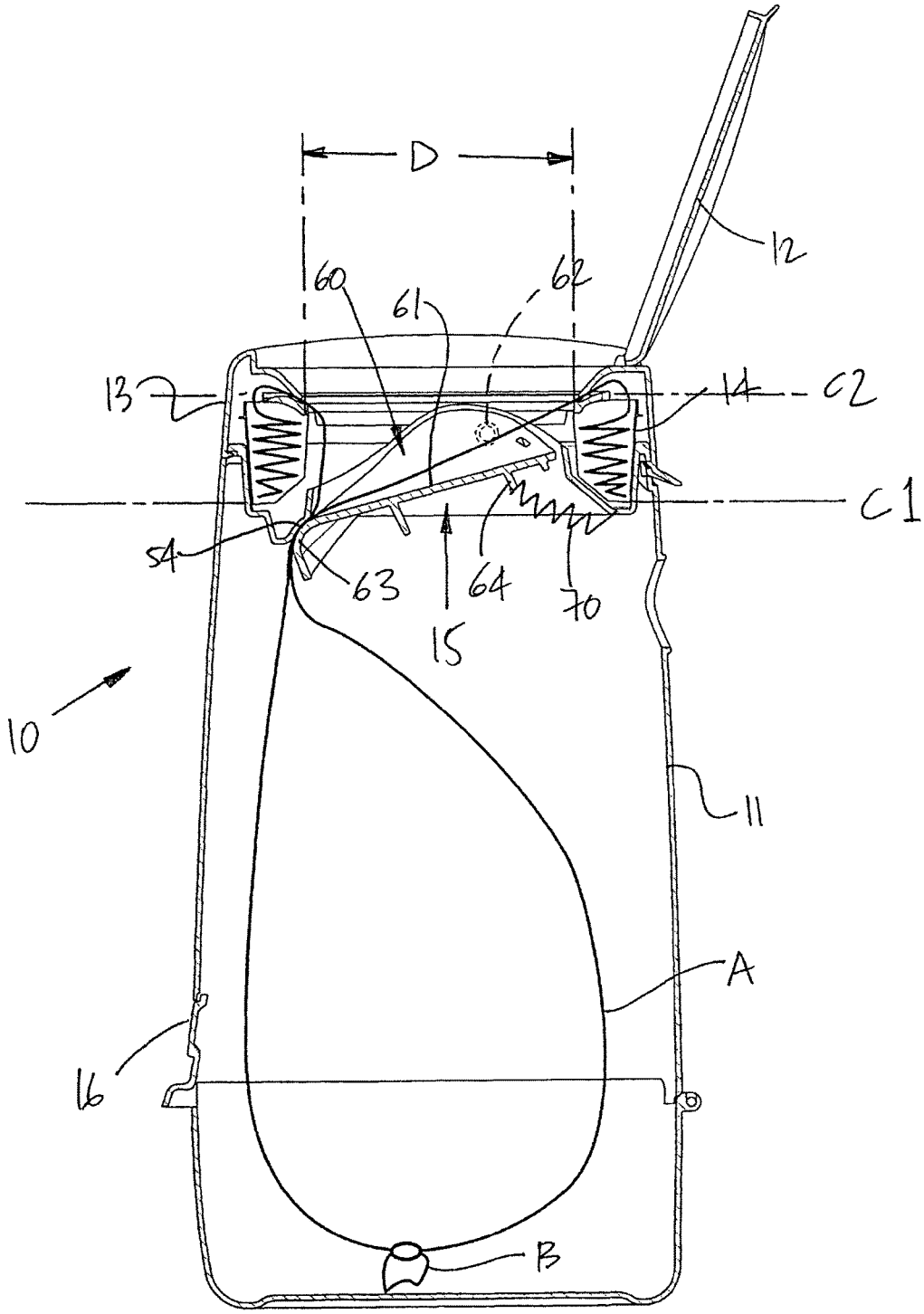
FIG. 6 is a sectional view of the waste-disposal device of FIG. 1, with a door in a closed position.
Figure 7:
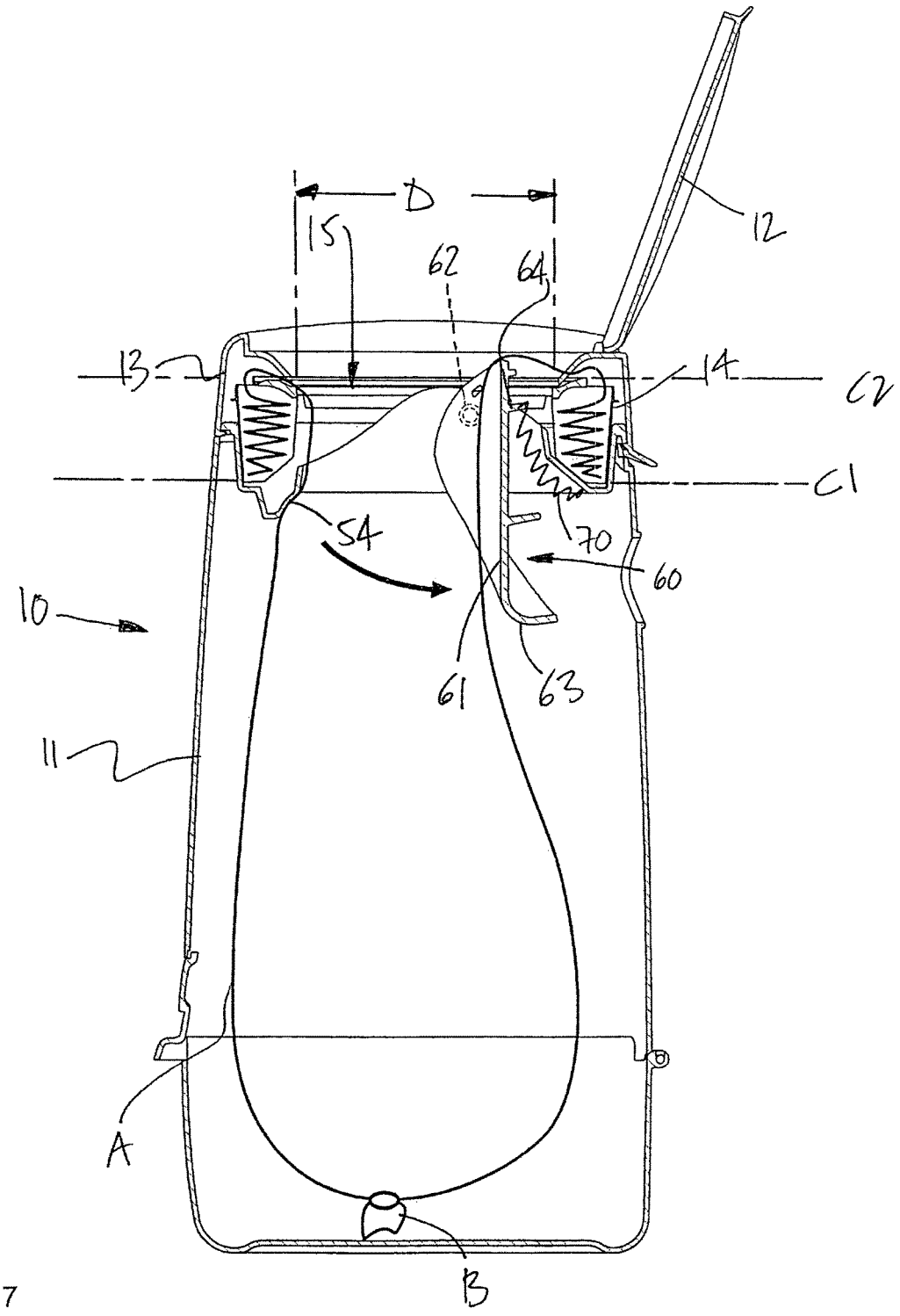
FIG. 7 is a sectional view of the waste-disposal device of FIG. 1, with a door in an open position.

The funnel 13 comprises a structural rim for being releasably connected to the top open end of the bin 11, and a funnel plate best seen in FIGS. 6 and 7. The funnel plate tapers toward a central opening of the bin 11 to guide waste material into a bag made from a tube A knotted at B to form a bag, that is provided to protect a tube dispensing unit 14 that is supported by the bin 11. Additional covering devices could also be used in addition to the lid 12 and the funnel 13.

The tube-dispensing unit 14 (also referred to as bag unit) dispenses tubular film in the form of a knotted bag and is therefore manipulated by the user, and is typically sold separately from the waste-disposal device 10 (i.e., bin 11, lid 12, funnel 13, and closing mechanism) of the waste-disposal device 10. Due to its manipulation, it may be desired to protect the tube-dispensing unit 14 from waste, by way of the funnel 13. The tube-dispensing unit 14 has an annular component, typically a rigid ring or annular casing (e.g., with annular cavity) from which the tube is dispensed.

Closing mechanism 15 shuts the bag of the tube-dispensing unit 14 to capture odorous gases within the waste-disposal device 10. The closing mechanism 15 is described in greater detail hereinafter.

Detent 16 may be provided on the outer surface of the bin 11. The detent 16 is pressed to separate the bottom 11B from the upper part 11A of the bin 11, so as to access an interior of the bin 11, for instance, to cut away full bags. As shown in FIG. 3, the upper part 11A may be pivotally connected to the bottom part 11B by a pivot joint 11C.

Referring to FIGS. 6-7, the tube-dispensing unit has a casing with a generally annular hollow body to accommodate the tubular film A in an accumulated condition, for subsequent dispensing thereof. The annular hollow body may have a generally U-shaped section, with the tubular film being accumulated in the bottom of the u. However, any other appropriate tube-dispensing unit 14 may be used, such as sleeves supporting bag, rimmed bags, etc, with appropriate hook means to hang the tube-dispensing unit 14 to the bin 11. Moreover, the outer shape of the hollow body may be any appropriate shape, such as that of a square, an ellipse, a circle, etc. The expression "annular" indicates the presence of a central opening.

Figure 5:
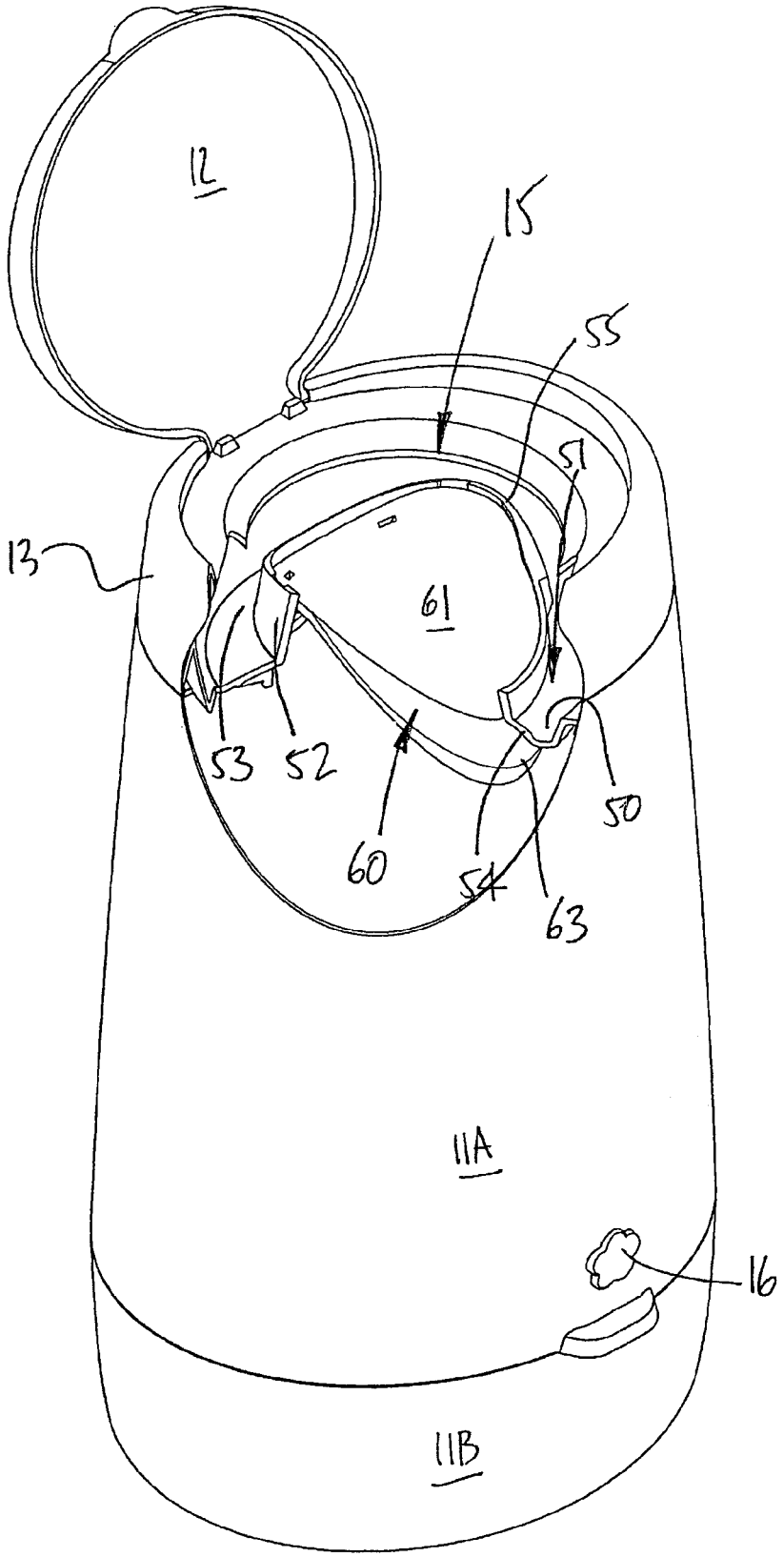
FIG. 5 is a perspective view, fragmented, of the waste-disposal device of FIG. 1, with a lid open.

Referring to FIG. 5, the closing mechanism 15 is shown in greater detail. The closing mechanism 15 comprises a support ring 50 by which it will support the tube-dispensing unit 14 at the top of the bin 11. The support ring 50 defines an annular cavity 51 that will receive the tube-dispensing unit 14. As illustrated in FIG. 5, the annular cavity 51 may have a U-shaped section.

An inner annular wall 52 defines the central opening of the support ring 50, through which the tube A will pass to reach an inner cavity of the bin 11 (FIGS. 6 and 7). The support ring 50 may also have an oblique portion 53 within the annular cavity 51, to ensure that the tube-dispensing unit 14 is correctly oriented when installed in the support ring 50. An abutment surface 55 is radially inward of the support ring 50, and is provided to squeeze the tube A shut, as in FIGS. 6 and 7. The support ring 50 may further comprise a pair of raised portions 55 (only one of which is visible in FIG. 5). Any other appropriate configuration of the ring 50 may be used. The expression ring is used to indicate that a central opening is present in the component 50 supporting the tube-dispensing unit 14. The support ring 50 is shown in FIGS. 5-7 as being releasably connected to the bin 11. The support ring 50 may alternatively be an integral part of the bin 11, or of the funnel 13, etc.

Referring concurrently to FIGS. 5-7, the closing mechanism 15 further comprises a door 60 (a.k.a., trap, flap, check valve, etc). The door 60 is the moving component of the closing mechanism 15. The door 60 is pivotable between a closed position (FIG. 6) and an open position (FIG. 7) relative to the support ring 50. In the open position, the door 60 is moved away from the abutment surface 54 to allow an access to an interior of the bin 11 and thus to the closed end of the bag during waste disposal. In the closed position, the door 60 is biased toward abutment with the abutment surface 54 of the support ring 50, to squeeze the tube B therebetween and thus seal it shut.

The door 60 may have a concave top surface 61. When the door 60 is in the open position as in FIG. 7, the concavity in the door 60 increases the space between the top surface 61 and the abutment surface 54, over the space that would be defined by a flat top surface of the door 60 instead of the concave surface. Pivots 62 are provided on opposite sides of the door 60, and may be molded integrally therewith. The pivots 62 are pivotally engaged to the raised portions 55 (FIG. 5) of the support ring 50. The door 60 has a tongue 61, at its bottommost end, the tongue being urged to come into contact against the abutment surface 54 when the door 60 is closed (FIG. 6). It is pointed out that the tongue 61 does not actually come into contact with the abutment surface 54 during use, as the tube A is squeezed therebetween. Hence, the abutment surface 54 and the tongue 61 may have matching surface geometries, to define a non-negligible overlapping surface therebetween, although an overlapping edge may suffice.

One or more hooks 64 (one shown in FIGS. 6 and 7) are formed in a bottom surface of the door 60. The hooks 64 are used to connect a free end of a spring 70 to the door 60. The other end of the spring 70 is connected to the support ring 50, or to any other fixed component of the bin 11, the cover 12 or the funnel 13. Hence, the door 60 is biased by the spring (s) 70 to the closed position of FIG. 6.

It is observed that the pivots 62, and therefore a pivot axis of the door 60, are located higher than the bottommost level CI of a casing of the tube-dispensing unit (i.e., a bottom edge surface of the casing in FIGS. 6 and 7). Hence, only a portion of the door 60 extends into the waste-receiving inner cavity of the bin 11. The positioning of the pivot axis of the door 60 vertically higher than the bottom of the tube-dispensing unit 14 results in the closing mechanism 15 taking less waste-disposal space of the bin 11 than the prior-art closing mechanisms located substantially below the tube-dispensing unit 14. As seen in FIG. 6, in the closed position of the door 60, most of the door 60 is higher that level CI. In the open position of the door 60 more than half of the door 60 is higher than the level CI. The pivot axis of the pivots 62 is shown as being below an uppermost level C2 of the tube-dispensing unit 14 in FIGS. 6 and 7. By being located between the levels CI and C2, the amount of waste-disposal space of the bin 11 is optimized with respect to the volume used for the closing mechanism 15. The pivot axis of the pivots 62 may however be located above the level C2.

Figure 8:
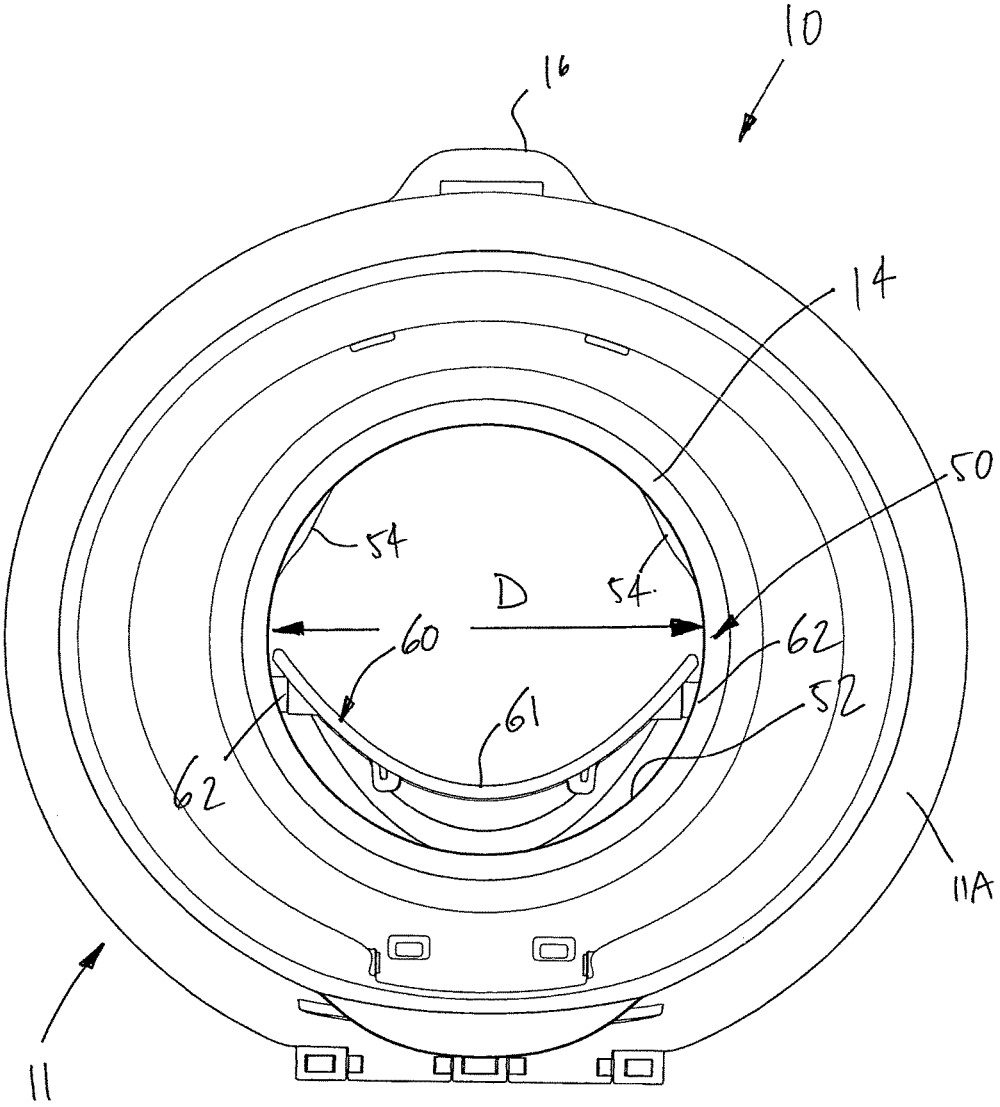
FIG. 8 is a top plan view of the waste-disposal device of FIG. 7.

Referring to FIGS. 6, 7 and 8, the pivots 62 are shown as being located inward of an inner diameter of the tube-dispensing unit 14, or a vertical projection thereof, i.e., within the lines shown as D in FIGS. 6 and 7.

Referring to FIG. 8, it is shown that the door 60 may be curved, e.g., being a cutout of a cylinder. The curvature of the door 60 is oriented to form an upwardly-facing concavity. Hence, when the door 60 is open as in FIGS. 6 and 7, the curvature of the door 60 conforms to that of the tube-dispensing unit 14, thereby minimizing the space taken by the door 60 in the opening of the tube-dispensing unit 14. In an embodiment, centers of the radii of the curvature of the tube-dispensing unit 14 and of the door 60, when the door 60 is open as in FIG. 8, are coincident or quasi-coincident (in close proximity to one another). A gap between an inner perimeter of the tube-dispensing unit 14 and the door 60 is relatively small. By minimizing the space taken by the door 60 by the matching curvatures, larger objects may more easily pass through the opening when dispensed in the bag A. In other words, a curvature of the door 60 has a center of radius on a same side as a radius of curvature of the central opening of the unit 14, and may even be located in a central opening of the unit 14.

The invention claimed is:

1. A waste-disposal device for use with a bag unit of the type having an annular component from which a free end of tube extends to form a bag, the waste-disposal device comprising:

a bin having an open top end for accessing an inner cavity of the bin, a support in the bin adjacent to the open top end and adapted to support the annular component of the bag unit for waste to be received in the bag of the bag unit extending in the inner cavity of the bin, by passing through a central opening thereof; and a closing mechanism comprising a door pivotally connected to the support by at least one pivot and an abutment surface in the bin, a pivot axis of the at least one pivot being located at a same height or higher than a bottommost edge of the annular component of the bag unit when received in the support and when the bin has a bottom thereof on the ground, the door being pivotable between a closed position in which the door presses the bag toward the abutment surface to close the bag, and an open position in which the door is away from the abutment surface to open the bag.

2. The waste-disposal device according to claim 1, wherein the support has a ring body to support the annular component of the bag unit.

3. The waste-disposal device according to claim 2, wherein the ring body defines an annular cavity for receiving the annular component of the bag unit.

4. The waste-disposal device according to claim 2, wherein the ring body has an inner annular wall located in the central opening of the annular component of the bag unit when the bag unit is in the support.

5. The waste-disposal device according to claim 4, wherein the at least one pivot has a portion connected to the inner annular wall.

6. The waste-disposal device according to claim 1, wherein the abutment surface is part of the support.

7. The waste-disposal device according to claim 6, wherein the abutment surface is oblique relative to a vertical axis of the bin to define a contact surface for the bag pressed by the door in the closed position.

8. The waste-disposal device according to claim 1, wherein the at least one pivot is located inside an vertical annular projection of the central opening.

9. The waste-disposal device according to claim 1, wherein the pivot axis is located at a same level or lower than an uppermost edge of the annular component.

10. The waste-disposal device according to claim 1, further comprising a biasing component between the door and the bin, to bias the door to the closed position.

11. The waste-disposal device according to claim 1, further comprising a lid selectively closing the open top end.

12. The waste-disposal device according to claim 11, further comprising an annular funnel to which the lid is pivotally connected, the annular funnel covering the annular component positioned in the support.

13. The waste-disposal device according to claim 1, wherein the door is curved.

14. The waste-disposal device according to claim 1, wherein a curvature of the door has a center of radius on a same side as a radius of curvature of the central opening.

15. The waste-disposal device according to claim 14, wherein the center of radius of the door is in the central opening.

* * * * *